United States Patent [19]

Steinberger

[11] Patent Number: 4,699,041

[45] Date of Patent: Oct. 13, 1987

[54] METHOD AND APPARATUS FOR ADJUSTING VALVES

[76] Inventor: Gary R. Steinberger, 4303 N. 47th St., Milwaukee, Wis. 53216

[21] Appl. No.: 874,074

[22] Filed: Jun. 13, 1986

[51] Int. Cl.[4] ..... F01B 25/26

[52] U.S. Cl. ..... 91/1; 33/607; 116/200

[58] Field of Search ..... 33/600, 607, 611; 91/1; 92/5; 116/28 R, 200, 298, 307, DIG. 21; 123/90.43, 90.45, 90.52

[56] References Cited

U.S. PATENT DOCUMENTS 3,964,172 6/1976 Wright ..... 33/611

4,393,693 7/1983 Naito ..... 33/611 X 4,411,288 10/1983 Gain, Jr. ..... 116/DIG. 21 X 4,580,446 4/1986 Ansteth ..... 116/DIG. 21 X

*Primary Examiner*—Robert E. Garrett

*Assistant Examiner*—Mark Williamson

*Attorney, Agent, or Firm*—James L. Kirschnik

[57] ABSTRACT

A method and apparatus for adjusting valves in automobile engines which utilizes an elongated indicating stick having a first set of indicia for identifying the specific valves to be adjusted with the engine in a first position, and a second set of indicia for indicating the particular valves to be adjusted following rotation of the engine one full turn in the normal direction of rotation.

5 Claims, 3 Drawing Figures

METHOD AND APPARATUS FOR ADJUSTING VALVES

BACKGROUND OF THE INVENTION

1. Field of the Invention

The present invention relates to a method and apparatus for the adjustment of valve lash in motor vehicles having adjustable valve lifter configurations. It is particularly applicable to engines manufactured by the Chevrolet Division of General Motors Corporation.

2. Background Information

Conventional automobile engines have use lifters which typically are interposed between a cam shaft and a push rod to move the push rod up and down as the cam shaft rotates. The push rods in turn engage a rocker arm which pivots up and down in response to movement of the push rod and activates an intake or exhaust valve in the engine. In certain engines, particularly those manufactured by the Chevrolet Division of General Motors Corporation, the individual rocker arms are adjustable to eliminate any slack between the valve stem, rocker arm, push rod and lifter when the valve is in a closed position and the cam is in its lowest position relative to the lifter.

The valve adjusting sequence for a multiple cylinder engine is to start with the engine in what is called the top dead center firing position for the number one cylinder. This position has both the intake and the exhaust valves closed for the number one cylinder. Depending upon whether the engine is a four cylinder, in-line six cylinder, V-6, or V-8, certain of the remaining cylinders will also have either an intake or exhaust valve in a closed position for adjustment purposes. After adjustment of certain designated intake and/or exhaust valves, the engine is typically rotated one full revolution in the normal direction of rotation to place all the remaining unadjusted valves in closed positions at which time they may be adjusted.

Adjustment of rocker arm nuts in an engine is typically necessary whenever any work is performed which affects the valve train. The specific adjusting sequence for any particular engine is generally described in the Service Manuals and will inform the mechanic as to which specific valves should be adjusted in the first or top dead center fire position for number one cylinder, and the remaining sequence for the other valves after rotation of the engine one full turn. A disadvantage of the present method of performing these adjustments is that the mechanic is forced to constantly refer to the service manual to determine the proper valve to be adjusted on a particular cylinder at a given position of the engine relative to the number one cylinder. This is time consuming, inefficient and can lead to errors in the adjusting sequence if a particular valve is forgotten or adjusted out of sequence.

SUMMARY OF THE INVENTION

The present invention provides a method and apparatus for increasing the efficiency by which adjustment of an automotive valve train may be performed. Depending upon the number of cylinders in a particular bank of any engine, an indicating stick is provided which extends the length of the cylinder head and is placed adjacent to the push rods for each of the valves in the cylinder bank. A first set of indicia are provided on the stick adjacent to the respective push rods of the valves which should be adjusted when the engine is in a first or top dead center firing position for cylinder number one. A second set of indicia is provided on the stick corresponding to the remaining valves to be adjusted after the engine is rotated one full revolution in the direction of normal rotation from the first position. Using the device according to the invention in this manner greatly increases the efficiency with which rocker arms may be adjusted and eliminates the necessity of cross-referencing to a separate service manual or other reference.

DESCRIPTION OF THE PREFERRED EMBODIMENT

Figure 1:
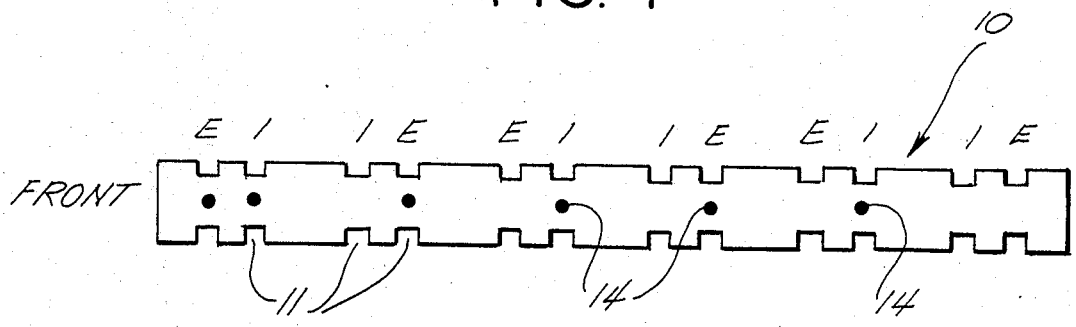
FIG. 1 depicts an indicating stick for adjusting rocker arms according the present invention for use with a 6 cylinder engine with the an indicating stick in its first position.
Figure 2:
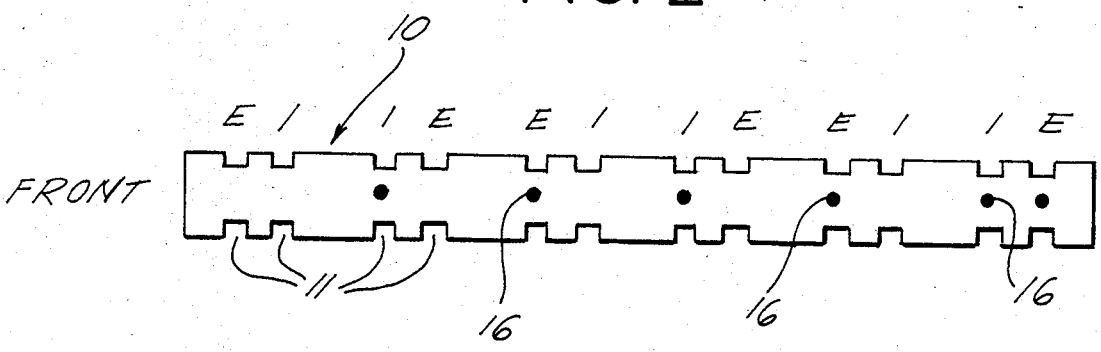
FIG. 2 is a plan view of the reverse side of the indicating stick shown in FIG. 1; and, FIG. 3 is a plan view of the indicating placed in relation to the cylinder head of a 6 cylinder engine adjusting valves according to the invention.

As seen in FIG. 1, an indicating stick 10 according to the invention is shown which comprises an elongated planar stick of material shown in plan view. The stick 10 shown in FIG. 1 is adapted to be used in a in-line 6 cylinder engine and along each longitudinal edge of the strip 10 there are a plurality of notches 11 spaced to correspond with the engine push rods. In the case of 6 cylinder in-line engine there would be twelve notches 11 on each side of stick 10. Starting at the left end of the stick 10, which would be placed at the front of the engine, the notches 11 would align with either an intake valve push rod designated by the letter "I" or an exhaust valve push rod designed by the letter "E". The top surface of the stick 10, contains a first set of distinct indicia 14. The first set of indicia may be for example blue dots which correspond with certain selected notches 11. FIG. 2 shows the lower surface of the stick 10. The lower surface contains a second set of indicia or marks 16 which in this case may be red dots which align with those notches 11 that had no corresponding indicia 14 on the upper surface. The reason for this will be explained hereinafter.

Figure 3:
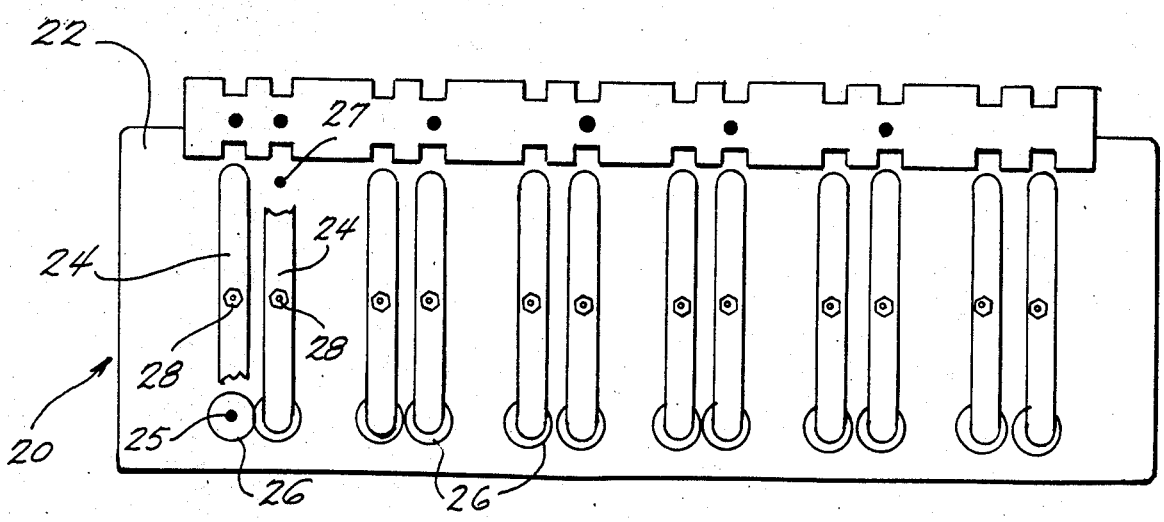

FIG. 3 shows a conventional Chevrolet in line six cylinder engine head assembly 20 with the valve cover removed. The head assembly 20 generally consists of the cylinder head 22 which is typically affixed to the engine block by bolts not shown. Extending along the center of the cylinder head assembly 20 are the rocker arms 24 corresponding to the number of valves in the cylinder head 22. In the case of a 6 cylinder engine there would be twelve (12) valves consisting of intake and exhaust valves for the six cylinder engine. The valve intake assemblies are not shown in detail but generally consist of a valve extending into the cylinder head portion of the engine and having an upstanding valve stem 25 extending upward through and the cylinder head and terminating beneath the rocker arms 24 and also having a spring assembly 26 for holding the valve in a normally closed position. At the opposite end of the rocker arms, a push rod 27 extends down through the cylinder head 22 and terminates within the engine block at a valve lifter not shown. The push rods 27 when extended upward push the rocker arm downward on the valve side to open the corresponding valve within the cylinder head. In the Chevrolet designed engine each of the rocker arms 24 has an adjusting nut assembly 28 which permits each rocker arm 24 to be adjusted to remove any slack between the push rods 27, lifters, valve stems 25 and the rocker arms 24 when the valves are in a closed position.

In the engine block 20 shown in FIG. 3, the left end will be assumed to be the front of the engine with the first cylinder being the number one cylinder proceeding with two through six toward the right side of the block. In adjusting the valves of the standard six cylinder Chevrolet engine, the crank shaft is rotated clockwise when facing the engine to place the number one piston, not shown, in a position of firing at top dead center. The firing position for cylinder number one has the cam shaft positioned so that the intake and exhaust valves are both closed. In this position, the number two cylinder has the exhaust valve closed, the number three cylinder has the intake valve closed, the number four cylinder has the exhaust valve closed and the number five cylinder has the intake valve closed. As seen in FIGS. 1 and 3, the indicating stick 10 has the blue indicia 14 on the top side at the notches corresponding to these respective valves which are in the closed position with the number one cylinder in the top dead center firing position. The indicating stick 10 is placed on the upper surface of the cylinder head assembly 20 adjacent to the push rods 27 with the respective notches 11 in alignment therewith so that the first set of blue indicia 14 provide an easy reference point for the mechanic to determine exactly which rocker arms 24 should be adjusted in this position. The adjusting procedure is conventional and well known to those skilled in the trade and need not be described in detail.

Following adjustment of the valve lash with the engine in the number one top dead center firing position, the crank shaft is rotated one full turn clockwise which places the remaining unadjusted valves in a closed position. In accordance with the invention, the indicating stick 10 is simply flipped over to align the bottom side and second set of red indicia 16 with those push rods and rocker arms which remain to be adjusted in the second position of the engine.

As will be appreciated by those skilled in the art, the device and method according to the invention provides a very simple but effective guide for determining which particular rocker arms should be adjusted at a given engine crank shaft position. While the method and device has been described in the context of an in-line six cylinder engine, it will be obvious to those skilled in the art that the invention is equally applicable to the cylinder banks of V-type engines or engines having a smaller or larger bank of cylinders. In the case of a V block engine, two indicating sticks are provided, one being for one bank of cylinders and the second being for the other bank of cylinders, however the principle behind the invention remains the same. The material from which the guide stick 10 is constructed is preferably of an oil and grease resistant material such as heat resistant plastic, metal or other suitable materials. Additionally, while the invention has been described with the indicia being provided in the form of colored markings on the upper and lower surfaces of the indicating stick 10, those skilled in the art will appreciate that any other suitable markings could be utilized as long as they conform to the particular valves to be adjusted in a particular position of the engine. Also, the indicia could all be located on the same surface as long as two distinct sets are provided. Furthermore, while the preferred embodiment utilizes a plurality of notches 11 on each of the longitudinal edges of the indicating stick 10, the notches are more for convenience than being one of necessity. The guide stock could easily be made without them just as long as the appropriate location of the two sets of indicia is provided.

In practice, depending upon the method by which the valves are adjusted, use of the present invention has been found to save time in the process of valve adjustment by fifteen minutes to over one hour. While a preferred embodiment of the invention has thus been described, the scope of the invention is not to be limited thereby but is to be taken solely from an interpretation of the claims which follows.

I claim:

1. An indicating stick for use in the adjustment of rocker arms of a conventional automobile engine wherein said engine comprises at least one bank of three or more cylinders and including a cylinder head in which at least one intake and exhaust valve are provided for each cylinder, said valves being operated via a cam shaft, lifters, push rods and rocker arms associated with each valve and wherein said rocker arms are individually adjustable to compensate for any gaps between said lifter, push rod, rocker arm and valve when each valve is in a closed position, said engine having a crank shaft which may be rotated to a first position in which a specific number of said intake and exhaust valves are in a closed position, and a second position in which the remaining intake and exhaust valves are in a closed position, said indicating stick comprising:

a. an elongated strip of material having a length substantially equal to the length of said cylinder bank;

b. said elongated material having a first set of spaced indicia formed therein to correspond with each valve which is closed when said crank shaft is in said first position; and c. a second set of spaced indicia formed in said elongated material and located to correspond with the remaining valves which are closed when said crank shaft is in said second position.

2. An indicating stick as set forth in claim 1 wherein said elongated material has a first surface on which said first set of indicia are located and a second surface on which said second set of indicia are located.

3. An indicating stick as set forth in claim 1 wherein said elongated material comprises a rectangular strip of material having generally planar upper and lower surfaces and wherein said first and second sets of indicia are formed in said upper surface.

4. An indicating stick as set in claim 1 wherein said elongated material comprises a generally rectangular strip of material having generally planar upper and lower surface, said upper surface having said first set of indicia formed therein and said lower surface having said second set of indicia formed therein.

5. A method of adjusting lifters in a conventional gasoline engine having a plurality of cylinders, a crank shaft which drives individual pistons contained within said cylinders and having a cam shaft for activating lifters, push rods and rocker arms for opening and closing intake and exhaust valves, said engine having one cylinder designated as the number one cylinder and said rocker arms being individually adjustable to eliminate slack between said valves, rocker arms, push rods and lifters, said method comprising:

a. rotating the crank shaft to place the number one piston in a top dead center position within the cylinder for firing wherein said intake and exhaust valves in said number one cylinder are in a closed position;

b. placing an elongated indicating stick having a first and second set of indicia spaced along said stick and alignable with a plurality of the valves of said engine, said first set of indicia located to correspond with the appropriate rocker arms to be adjusted when the engine is in said first position;

c. adjusting each of the rocker arms corresponding to the first set of indicia;

d. rotating said engine crank shaft one full turn in the normal direction of rotation;

e. aligning said second set of indicia with each other valve whose rocker arm had not been previously adjusted; and f. adjusting the rocker arms of the engine which correspond to the second set of indicia.

* * * * *